US010774673B2

(12) United States Patent
Leopold

(10) Patent No.: US 10,774,673 B2
(45) Date of Patent: Sep. 15, 2020

(54) GUIDE VANE ADJUSTMENT DEVICE AND TURBOMACHINE

(71) Applicant: MAN DIESEL & TURBO SE, Augsburg (DE)

(72) Inventor: Lennart Leopold, Berlin (DE)

(73) Assignee: MAN Energy Solutions SE, Augsburg (DE)

( * ) Notice: Subject to any disclaimer, the term of this patent is extended or adjusted under 35 U.S.C. 154(b) by 109 days.

(21) Appl. No.: 15/566,483

(22) PCT Filed: Apr. 14, 2016

(86) PCT No.: PCT/EP2016/058181

§ 371 (c)(1),
(2) Date: Oct. 13, 2017

(87) PCT Pub. No.: WO2016/166191

PCT Pub. Date: Oct. 20, 2016

(65) Prior Publication Data

US 2018/0100407 A1 Apr. 12, 2018

(30) Foreign Application Priority Data

Apr. 15, 2015 (DE) ..... 10 2015 004 648

(51) Int. Cl.
*F01D 17/12* (2006.01)
*F01D 17/16* (2006.01)
(Continued)

(52) U.S. Cl.
CPC ..... *F01D 17/162* (2013.01); *F01D 9/041* (2013.01); *F01D 17/00* (2013.01); *F01D 17/167* (2013.01);
(Continued)

(58) Field of Classification Search
CPC ..... F01D 17/162; F01D 9/041; F01D 17/00; F01D 17/167; F01D 5/02; F04D 29/563; F04D 29/566; F05D 2260/50
(Continued)

(56) References Cited

U.S. PATENT DOCUMENTS 4,049,360 A * 9/1977 Snell ..... F01D 17/162 415/149.4
4,097,187 A * 6/1978 Korta ..... F01D 17/162 415/161
(Continued)

FOREIGN PATENT DOCUMENTS

CN 102498284 6/2012
DE 26 18 727 11/1976
(Continued)

OTHER PUBLICATIONS

Office Action dated Jul. 10, 2018 issued in the corresponding Russian Patent Application No. 2017139321.
(Continued)

*Primary Examiner* — Hung Q Nguyen
*Assistant Examiner* — Anthony Donald Taylor, Jr.
(74) *Attorney, Agent, or Firm* — Cozen O'Connor

(57) ABSTRACT

Guide vane adjusting device for a flow machine to rotate guide vanes, with a driveshaft, and a control ring that transmits rotation of the driveshaft to rotate the guide vanes. The driveshaft is directly coupled with one of the guide vanes to be directly rotatable by the driveshaft without the intermediary of the control ring. The directly driven guide vane is articulately coupled with the control ring via a transmission lever. The other guide vanes are indirectly rotatable with the intermediary of the control ring. The control ring is displaceable in circumferential and axial direction such that forces at coupling points between the
(Continued)

control ring and the transmission levers coupled with the control ring run perpendicular to the transmission levers.

5 Claims, 14 Drawing Sheets

(51) Int. Cl.
*F04D 29/56* (2006.01)
*F01D 17/00* (2006.01)
*F01D 9/04* (2006.01)
*F01D 5/02* (2006.01)

(52) U.S. Cl.
CPC ..... *F04D 29/563* (2013.01); *F04D 29/566* (2013.01); *F01D 5/02* (2013.01); *F05D 2260/50* (2013.01)

(58) Field of Classification Search
USPC ..... 415/148
See application file for complete search history.

(56) References Cited

U.S. PATENT DOCUMENTS 4,130,375 A * 12/1978 Korta ..... F01D 17/162 415/161
4,139,329 A * 2/1979 Korta ..... F01D 17/162 415/161
4,239,450 A * 12/1980 Geitner ..... F04D 29/46 415/160
4,299,535 A * 11/1981 Brockman ..... F04D 29/462 415/160
4,400,135 A * 8/1983 Thebert ..... F01D 17/162 415/134
4,741,665 A * 5/1988 Hanser ..... F01D 17/162 415/150
5,035,572 A * 7/1991 Popp ..... F01D 17/162 415/12
5,096,374 A * 3/1992 Sakai ..... F01D 17/162 384/206
5,215,434 A * 6/1993 Greune ..... F01D 17/162 415/150
9,188,138 B2 * 11/2015 Keegan ..... F01D 17/162
2006/0062667 A1 * 3/2006 Bourgoin ..... F01D 17/162 415/199.1
2007/0068155 A1 * 3/2007 Hayashi ..... F01D 17/165 60/602
2008/0050220 A1 * 2/2008 Merry ..... F01D 17/162 415/160
2008/0056904 A1 * 3/2008 Somanath ..... F01D 5/148 416/233
2009/0226305 A1 * 9/2009 Wong ..... F01D 17/162 415/160
2011/0171009 A1 * 7/2011 Espasa ..... F01D 17/165 415/163
2011/0182715 A1 * 7/2011 Leithead ..... F01D 17/162 415/148
2012/0263586 A1 * 10/2012 Patil ..... F04D 27/0246 415/208.1
2013/0216353 A1 * 8/2013 Nowicki ..... F03B 3/183 415/9
2013/0266424 A1 * 10/2013 Soehner ..... F01D 9/00 415/148
2014/0127003 A1 * 5/2014 Klauke ..... F01D 9/045 415/148

FOREIGN PATENT DOCUMENTS

DE 690 10 519 11/1994
EP 0381399 7/1994
JP H 02-291500 12/1990
JP H02291500 * 12/1990 ..... F04D 29/46
JP 2006-090319 4/2006
RU 2509897 C2 3/2014

OTHER PUBLICATIONS

Office Action and an English translation dated Nov. 19, 2018 issued in Japanese Patent Application No. 2017-553951.
Office Action dated Dec. 13, 2018 issued in Korean Patent Application No.10-2017-7032955.
Office Action dated Dec. 17, 2018 issued in Chinese Patent Application No. 201680021800.9.
Office Action dated Jul. 12, 2019 issued in Chinese Patent Application No. 201680021800.9.
Office Action dated Jul. 22, 2019 issued in Japanese Patent Application No. 2017-553951.
Office Action dated Feb. 11, 2020 issued in India Patent Application No. 201747040359.

* cited by examiner

GUIDE VANE ADJUSTMENT DEVICE AND TURBOMACHINE

CROSS REFERENCE TO RELATED APPLICATIONS

This is a U.S. national stage of application No. PCT/EP2016/058181, filed on Apr. 14, 2016. Priority is claimed on German Application No. DE102015004648.9, filed Apr. 15, 2015, the content of which is incorporated here by reference.

BACKGROUND OF THE INVENTION

1. Field of the Invention

The invention is directed to a guide vane adjusting device for a flow machine and a flow machine with a guide vane adjusting device of this type.

2. Description of the Prior Art

Flow machines known from practice have a rotor and a stator. The rotor of a flow machine comprises a shaft and a plurality of blades rotating together with the shaft. The blades form at least one rotor blade ring. The stator of a flow machine comprises a housing and a plurality of stationary guide vanes, these guide vanes forming at least one guide vane ring.

It is known from practice to adjust the guide vanes of a guide vane ring of a flow machine via a guide vane adjusting device such that the guide vanes are rotatable around a guide vane axis extending in radial direction of the rotor.

Guide vane adjusting devices known from practice have a driveshaft to which a drive motor can be coupled that is drivable via the drive motor. In guide vane adjusting devices known from practice, the rotation of the driveshaft via the drive motor is transmitted by a control ring to all of the guide vanes of a guide vane ring such that all of the guide vanes of a guide vane ring are accordingly adjusted or rotated indirectly proceeding from the driveshaft with the intermediary of the control ring. The control ring of guide vane adjusting devices known from practice is rotatable in circumferential direction, but is not displaceable in axial direction or radial direction.

Guide vane adjusting devices known from practice have the drawback that they incur a relatively large amount of friction. Further, they are subject to a high torsional load. Therefore, guide vane adjusting devices known from practice must have correspondingly large dimensions. However, this is disadvantageous in view of the limited installation space available in flow machines.

SUMMARY OF THE INVENTION

In view of the foregoing, an objective upon which one aspect of the invention is based is to provide a novel guide vane adjusting device for a flow machine and a flow machine with a guide vane adjusting device of this kind.

The driveshaft is directly coupled with one of the guide vanes of the guide vane ring such that this guide vane of the guide vane ring is directly rotatable proceeding from the driveshaft without an intermediary of a control ring. The driveshaft, or the guide vane that is directly drivable by the driveshaft, is coupled with the control ring in an articulated manner via a transmission lever. The driveshaft is indirectly coupled with the other guide vanes of the guide vane ring such that the other guide vanes of the guide vane ring are indirectly rotatable proceeding from the driveshaft with the intermediary of the control ring. The guide vanes that are indirectly drivable by the driveshaft are coupled with the control ring in an articulated manner via further transmission levers. The control ring is displaceable in circumferential direction and in axial direction such that forces at coupling points between the control ring and the transmission levers, which are coupled with the control ring in an articulated manner, run perpendicular to the transmission levers.

The above-mentioned features combined with one another make it possible to lessen the incidence of friction and torsional loading. One of the guide vanes of a guide vane ring is directly rotatable by the driveshaft without the intermediary of the control ring. The other guide vanes of the guide vane ring are indirectly rotatable proceeding from the driveshaft with the intermediary of the control ring. The guide vane that is directly rotatable or directly coupled with the driveshaft is coupled with the control ring in an articulated manner via a transmission lever. Further, the guide vanes of the guide vane ring, which are indirectly rotatable or indirectly coupled with the driveshaft, are coupled with the control ring in an articulated manner via transmission levers. The control ring is guided so as to be displaceable in circumferential direction and in axial direction and is non-displaceably guided exclusively in radial direction. In this way, it can ultimately be ensured that forces at the coupling points between the control ring and the transmission levers coupled with the control ring in an articulated manner always run perpendicular to the transmission levers so that bearings of the guide vanes are not loaded by parasitic force components. In this way, a guide vane adjusting device can ultimately be dimensioned smaller so that its installation space requirement is reduced.

According to an advantageous further development of the invention, the driveshaft or the guide vanes that are directly drivable by the driveshaft is/are coupled with the control ring in an articulated manner via a transmission lever comprising multiple parts, a first segment of the multiple-part transmission lever being rigidly coupled with the driveshaft or with the guide vanes that are directly drivable by the driveshaft, and a second segment of the multiple-part transmission lever is coupled in an articulated manner with the control ring. The first segment of the multiple-part transmission lever is preferably coupled in an articulated manner with the second segment of the multiple-part transmission lever so as to form a two-part transmission lever. This allows the driveshaft or the guide vanes that are directly drivable by the driveshaft to be coupled with the control ring in a particularly advantageous manner.

According to a first variant of the invention, the guide vanes that are indirectly drivable by the driveshaft are coupled in an articulated manner with the control ring via one-part, elastically deformable transmission levers. Alternatively, according to a second variant of the invention, the guide vanes that are indirectly drivable by the driveshaft are coupled with the control ring in an articulated manner via multiple-part transmission levers, and a first segment of each of these multiple-part transmission levers is rigidly coupled with the respective guide vane, and a second segment of each of these multiple-part transmission levers is coupled in an articulated manner with the control ring. In the second variant, the first segment of the respective multiple-part transmission lever is then preferably coupled in an articulated manner with the second segment of the respective multiple-part transmission lever to form a two-part transmission lever. These two variants allow an advantageous coupling of the indirectly rotatable guide vanes to the control ring. The first variant with the one-part transmission levers between the control ring and the guide vanes which are indirectly drivable by the driveshaft is simpler with respect to construction than the second variant with the multiple-part transmission levers. However, the second variant with the multiple-part transmission levers is a more compact construction.

BRIEF DESCRIPTION OF THE DRAWINGS

Preferred further developments of the invention are indicated in the subclaims and following description. Without limiting generality, embodiment examples of the invention will be described more fully with reference to the drawings. The drawings show:

DETAILED DESCRIPTION OF THE PRESENTLY PREFERRED EMBODIMENTS

The present invention is directed to a guide vane adjusting device for a flow machine and to a flow machine with at least one guide vane adjusting device of this type.

The basic construction of a flow machine will be familiar to the person skilled in the relevant art. It is noted here for the sake of completeness that a flow machine includes a rotor with rotor-side guide blades and a stator with stator-side guide vanes.

The guide blades of the rotor form at least one guide blade ring, and the guide blade ring or each guide blade ring rotates together with a shaft of the rotor. The guide vanes of the stator form at least one guide vane ring that is connected to a stator-side housing.

Figure 1:
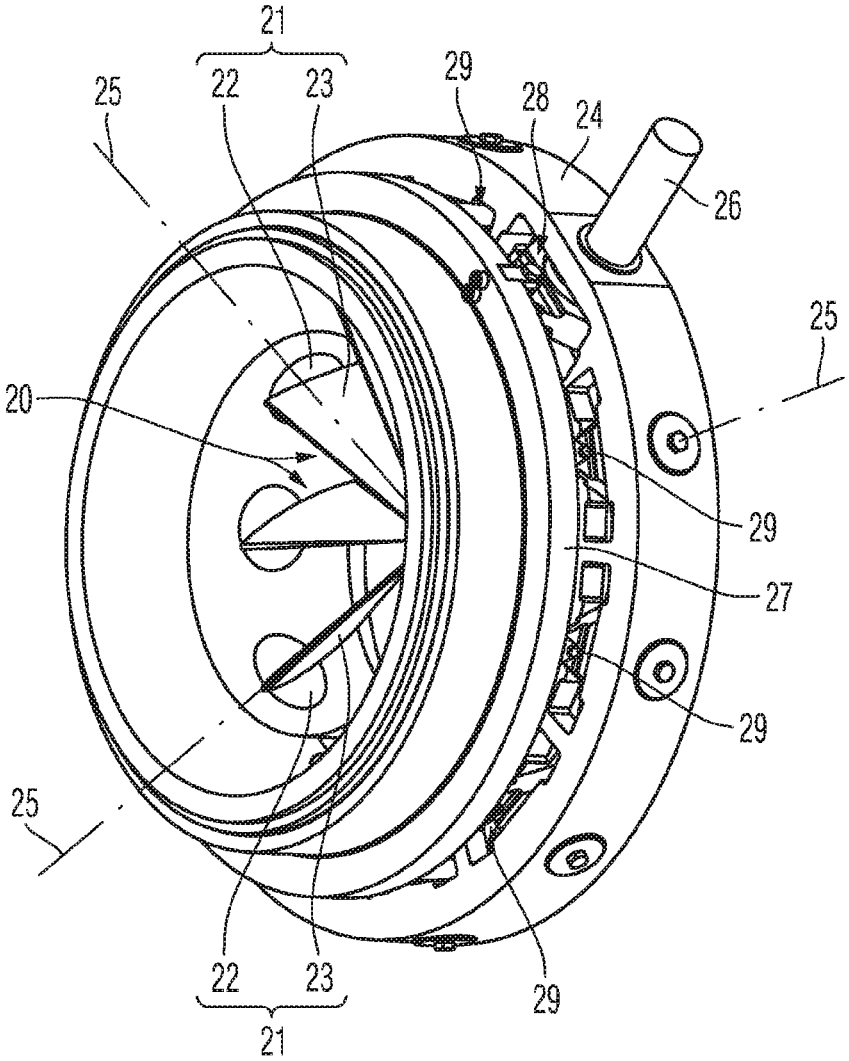
FIG. 1 is a perspective view of a detail from a flow machine in the region of a guide vane ring and a guide vane adjusting device for the guide vanes of the guide vane ring.

FIG. 1 shows a section from a flow machine in the region of a guide vane ring 20 having a plurality of guide vanes 21. Each of the guide vanes 21 has a vane root, or vane pin 22, and a vane blade 23, the vane pin 22 of the respective guide vane 21 being positioned radially outwardly and engaging at a housing structure 24 of the flow machine.

The present invention is directed to a guide vane adjusting device for the guide vanes 21 of a guide vane ring 20 of the above-mentioned type by which the guide vanes 21 can be rotated around guide vane axes 25 of the guide vanes 20, which guide vane axes 25 extend in radial direction of the rotor of the flow machine.

The vane roots 22 of the guide vanes 21 are accordingly rotatably mounted in the housing structure 24, namely such that each of the guide vanes 21 can be rotated around the respective guide vane axis 25 extending in radial direction.

The guide vane adjusting device for the rotation of the guide vanes 21 of the guide vane ring 20 around their guide vane axes 25 extending in radial direction comprises a driveshaft 26 that can be coupled to a drive motor, not shown, and which is drivable proceeding from the drive motor.

The driveshaft 26 is directly coupled to one of the guide vanes 21 of the guide vane ring 20, namely, such that this guide vane 21 of the guide vane ring 20 is directly rotatable proceeding from the driveshaft 26.

The driveshaft 26 preferably extends coaxial to the vane pin 22 of this directly rotatable guide vane 21 and coaxial to the vane axis 25 of this directly rotatable guide vane 21.

The guide vane adjusting device further comprises a control ring 27. The driveshaft 26, or the guide vane 21 that can be directly driven by the driveshaft 26, is coupled with the control ring 27 in an articulated manner via a transmission lever 28.

The driveshaft 26 is indirectly coupled with the other guide vanes 21 of the guide vane ring 20 via the control ring 27 such that the rest of the guide vanes 21 of the guide vane ring 20 are indirectly rotatable proceeding from the driveshaft 26, namely, with the intermediary of the control ring 27 that transmits the rotation of the driveshaft 26 to the rest of the guide vanes 21 of the guide vane ring 20. These guide vanes 21 of the guide vane ring 20 which are indirectly drivable and rotatable proceeding from the driveshaft 26 are coupled with the control ring 27 in an articulated manner via further transmission levers 29.

The control ring 27 to which the guide vanes 21 that are directly adjustable proceeding from the driveshaft 26 are connected via the transmission lever 28 on the one hand and to which the guide vanes 21 that are indirectly rotatable proceeding from the driveshaft 26 are connected via the transmission levers 29 on the other hand is displaceable in circumferential direction U and in axial direction A. Owing to this displaceability of the control ring 27 in circumferential direction U and in axial direction A and owing to the articulated connection of the transmission levers 28 and 29 to the control ring 27, forces acting during the rotation of the guide vanes 21 at the coupling points between the control ring 27 and the transmission levers 28, 29 which are coupled in an articulated manner with the control ring 27 always run perpendicular to the transmission levers 27, 28.

Figure 6:
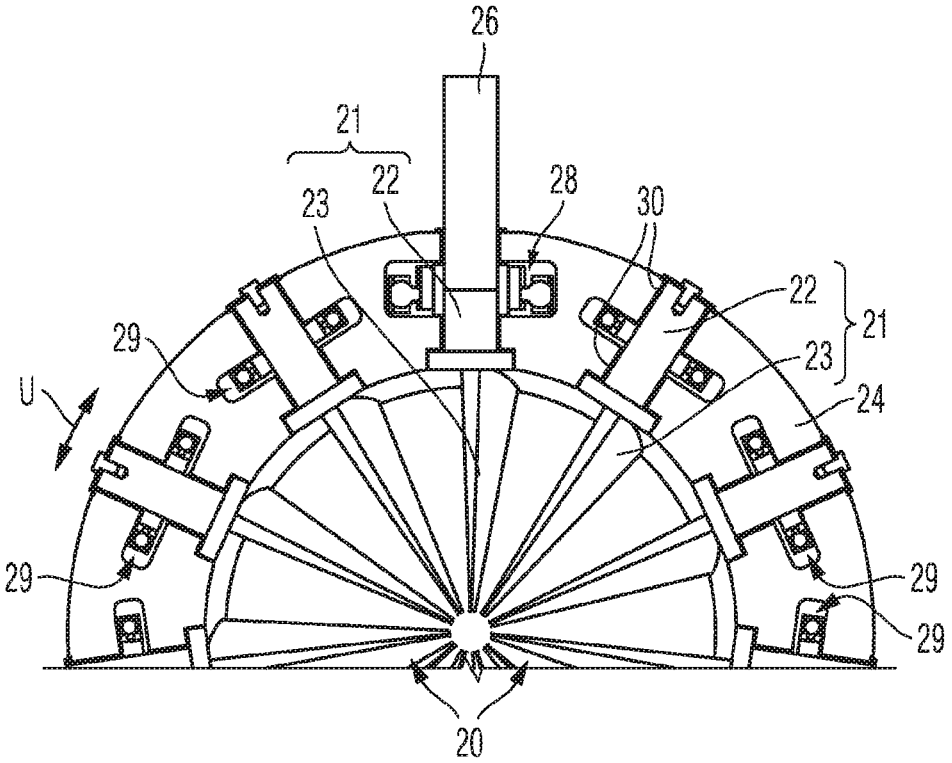
FIG. 6 is a partial cross section through an alternative guide vane adjusting device.

As a result of the above-mentioned features of the guide vane adjusting device, friction at the latter is reduced, and parasitic force components that act on the transmission levers in the prior art are prevented. As a result, bearings 30 of the guide vanes via which the latter are rotatably mounted in the housing structure 24 are less highly loaded. Referring to FIG. 6, each guide vane is radially and axially mounted at two locations by means of two bearings 30.

The driveshaft 26, or the guide vane 21, particularly the vane pin 22 thereof, which is directly drivable by the driveshaft, is coupled with the control ring 27 in an articulated manner via a multiple-part transmission lever 28. This multiple-part transmission lever 28 has at least one first segment 31 rigidly coupled with the driveshaft 26 or with the guide vane 21, which is directly drivable by the driveshaft 26, and a second segment 32 coupled with the control ring 27 in an articulated manner. This transmission lever 28, which serves to couple the directly rotatable guide vane 21 and driveshaft 26, respectively, to the control ring 27, is preferably formed as a two-part transmission lever, in which case the first segment 31 and the second segment 32 of the same are coupled in an articulated manner. In the preferred embodiment example shown here, two spherical joint bearings 33 are formed between the first segment 31 of the two-part transmission lever 28 and the second segment 32 of the latter. Further, another spherical joint bearing 34 is formed between the second segment 32 of this transmission lever 28 and the control ring 27.

In the embodiment examples of the guide vane adjusting device shown in FIGS. 1 to 9, the guide vanes 21 that are indirectly drivable proceeding from the driveshaft 26 are coupled with the control ring 27 via the transmission levers 29, which are also formed as multiple-part transmission levers 29 in the embodiment examples in FIGS. 1 to 9. Each of these transmission levers 29 has a first segment 35 rigidly coupled with the respective guide vane 21 and a second segment 36 coupled with the control ring 27 in an articulated manner. In the embodiment examples in FIGS. 1 to 9, these transmission levers 29 as well as transmission lever 28 are also constructed as two-part transmission levers 29. In this case, the first segment 35 of the respective transmission lever 29 is connected in an articulated manner with the second segment 36 of the transmission lever 29. According to the embodiment examples shown in FIGS. 1 to 9, two spherical joint bearings 37 are formed between the first segment 35 of the respective transmission lever 29 and the respective second segment 36 thereof, and a spherical joint bearing 38 is formed between the second segment 36 of the respective transmission lever 29 and the control ring 27.

Figure 10:
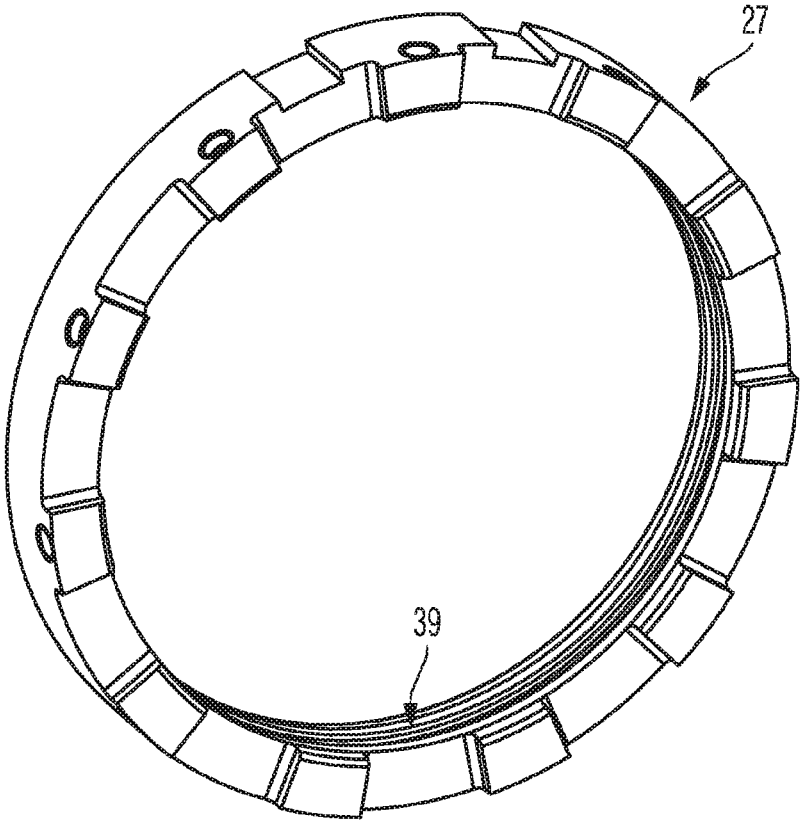
FIG. 10 is a detail of the guide vane adjusting devices.
Figure 11:
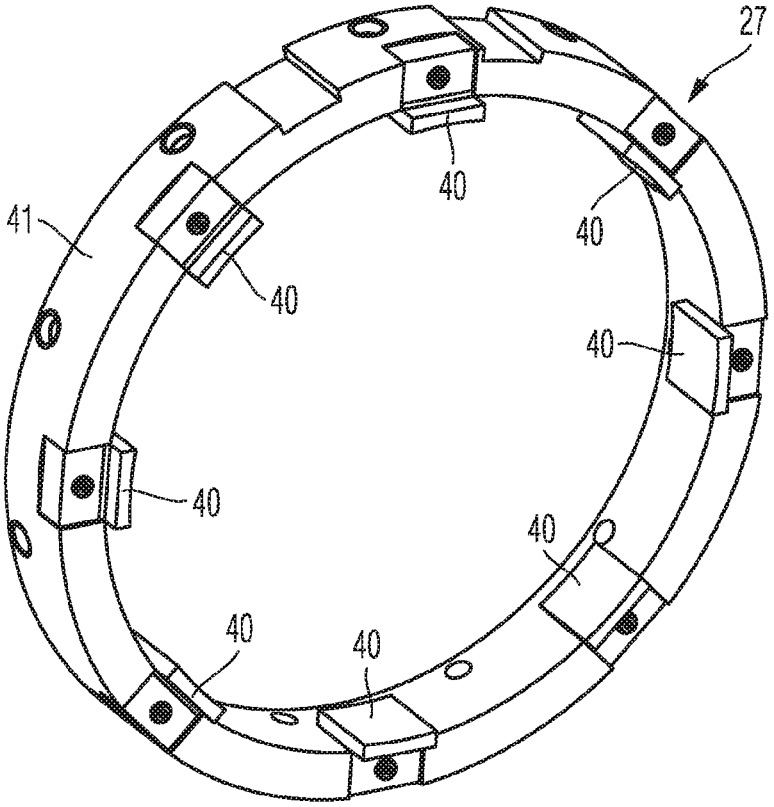
FIG. 11 is an alternative to the detail from FIG. 10.

As has already been stated, the control ring 27 is displaceable in circumferential direction and axial direction relative to the housing structure 24 and is guided and fixed only in radial direction. FIGS. 10 and 11 show a control ring 27 of this type by itself. An inner running surface 39 of the control ring 27 in FIG. 10 is preferably coated with sliding lacquer or a PTFE fabric in order to reduce friction at the control ring 27.

FIG. 11 shows an alternative construction of the control ring 27 formed of multiple parts rather than one part as in FIG. 10 and which comprises a plurality of sliding pads 40 that are detachably connected to a base body 41 of the control ring 27 in FIG. 11. The sliding pads 40 prevent a tilting of the control ring 27 during a movement thereof in axial direction and circumferential direction and allow the control ring 27 to be fitted to the housing structure 24 so as to be free of play. The sliding pads 40 are exchangeable and are preferably made from a material with good sliding properties and, accordingly, low friction coefficients. The sliding pads 40 are connected with the base body 41 in an articulated manner via sliding pad holders 40*a* such that they are supported in each instance so as to be rotatable around an axis extending tangential to the circumference and perpendicular to the rotational axis of the control ring 27.

As has already been stated, all of the transmission levers 28, 29 in the embodiment examples shown in FIGS. 1 to 9, i.e., on the one hand, transmission lever 28, which couples the driveshaft 26 or the guide vane 21 directly driven by the driveshaft 26 to the control ring 27 and, on the other hand, transmission levers 29, which couple the control ring 27 to the guide vanes 21 indirectly driven proceeding from the transmission shaft 26, are constructed of two parts in each instance. Three spherical joint bearings are formed in the region of each of the transmission levers 28, 29 so that, as can be seen particularly from a comparison of FIGS. 3 and 5, it is possible to compensate a height offset or radial offset between the respective transmission lever 28, 29 and the control ring 27, which varies during the rotation and axial displacement of the control ring 27.

Figure 12:
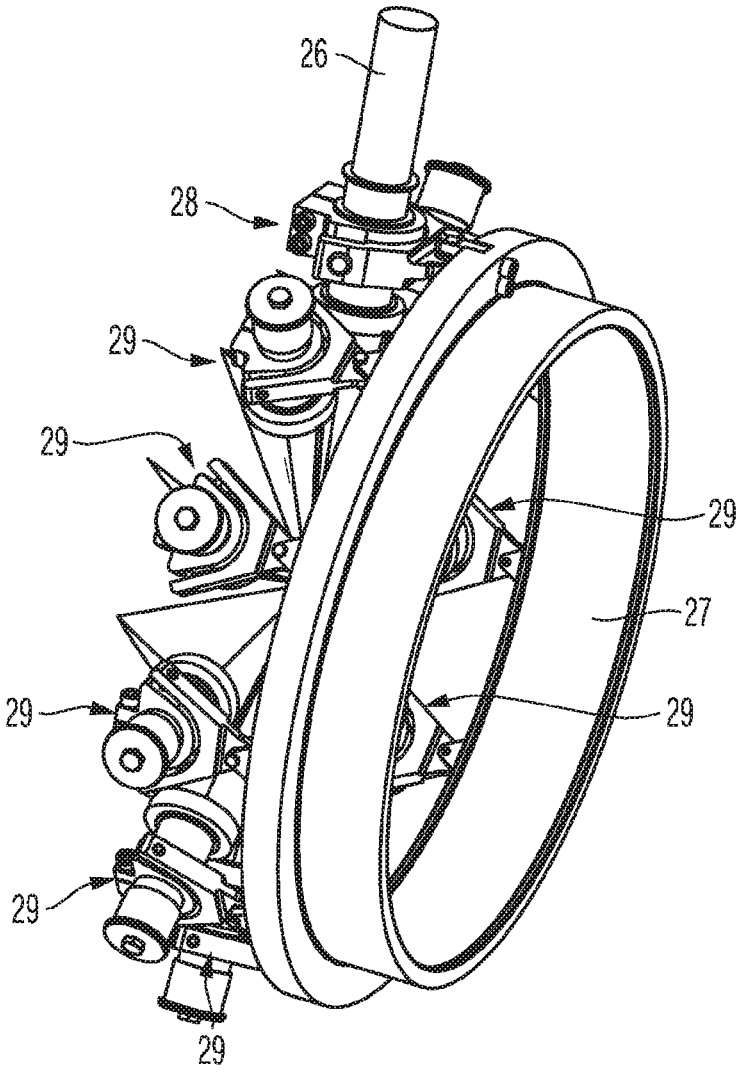
FIG. 12 is an alternative to the arrangement in FIG. 8.
Figure 13:
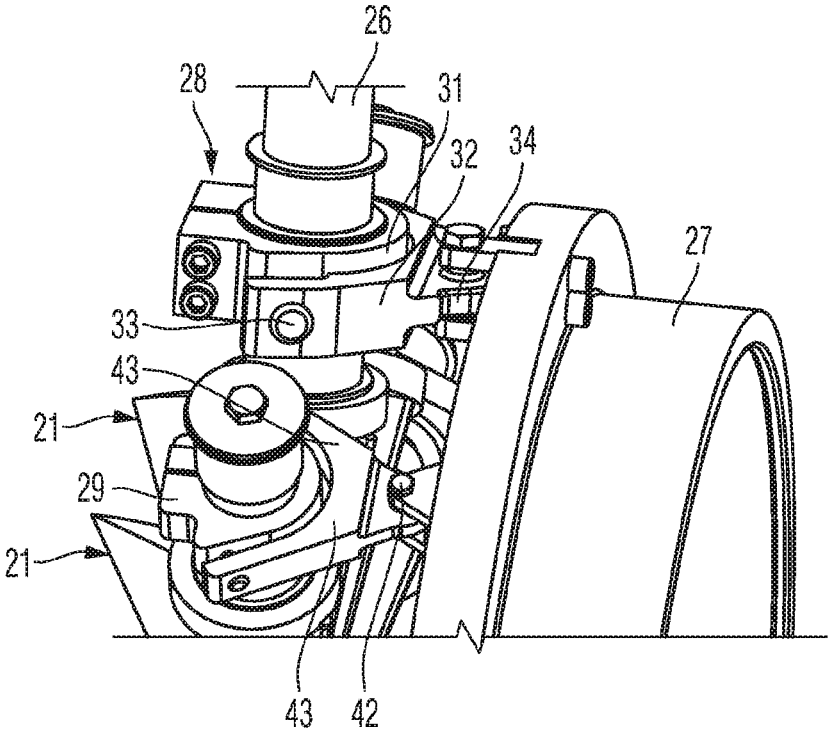
FIG. 13 is a detail from FIG. 12.
Figure 14:
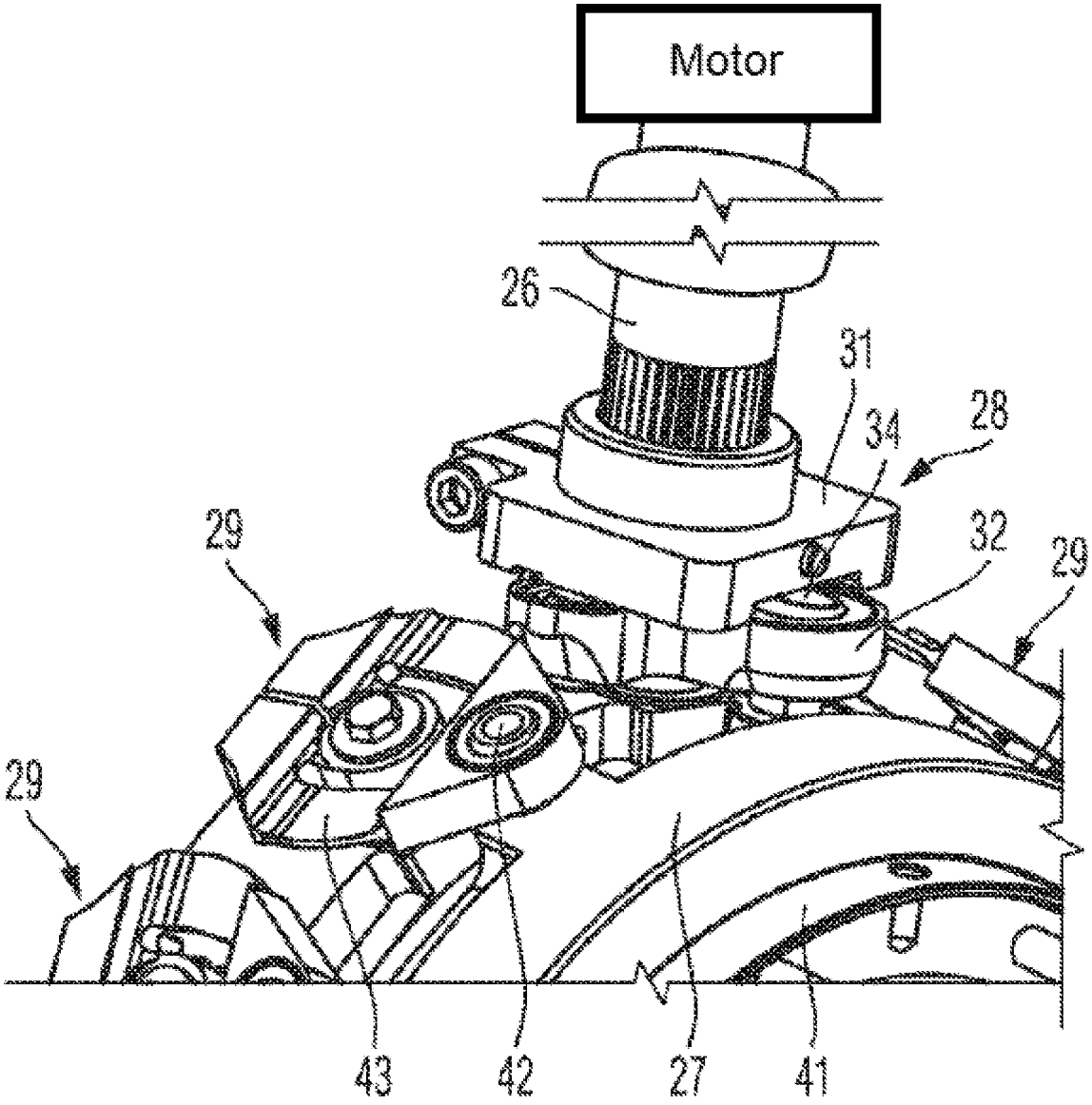
FIG. 14 is an alternative to the detail in FIG. 13.

FIGS. 12 to 14 show embodiment examples of the invention in which the transmission levers 29, which serve to couple the guide vanes 21 indirectly driven by the driveshaft 26 to the control ring 27, are formed as one-part, resiliently elastically deformable transmission levers 29. Accordingly, in the embodiment examples in FIGS. 12 to 13, the one-part, elastically deformable transmission levers 29 are fixedly coupled at one end to the respective guide vane 21 and at an opposite end, via a spherical joint bearing 42, to the control ring 27. In a transition portion 43 between these two ends of the respective transmission lever 29, the latter is resiliently elastically deformable so as to compensate a height offset or radial offset between the control ring 27 and the indirectly displaceable guide vanes 21 which varies during the circumferential displacement and axial displacement of the control ring 27.

The embodiment example in FIG. 14 differs from the embodiment example of FIGS. 12 and 13 with respect to the specific construction of the transmission levers 28 and 29.

While segments 31 and 32 of the transmission lever 28 are positioned substantially axially one behind the other in the embodiment example in FIGS. 1 to 9, these segments 31 and 32 of the transmission lever 28 are positioned substantially one above the other in radial direction in the embodiment example of FIG. 14.

Figure 2:
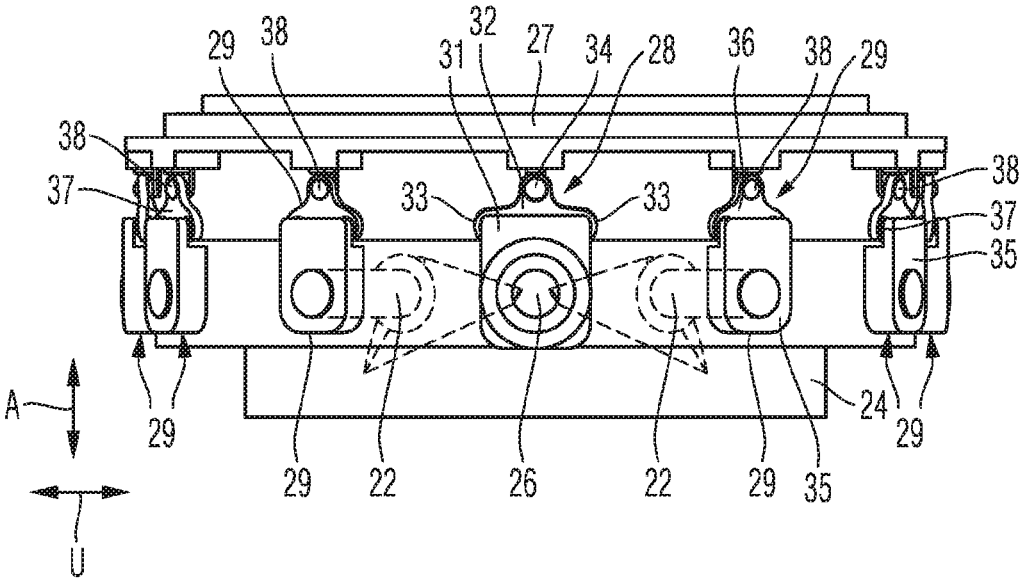
FIG. 2 is a top view of the arrangement from FIG. 1 in a first condition.
Figure 3:
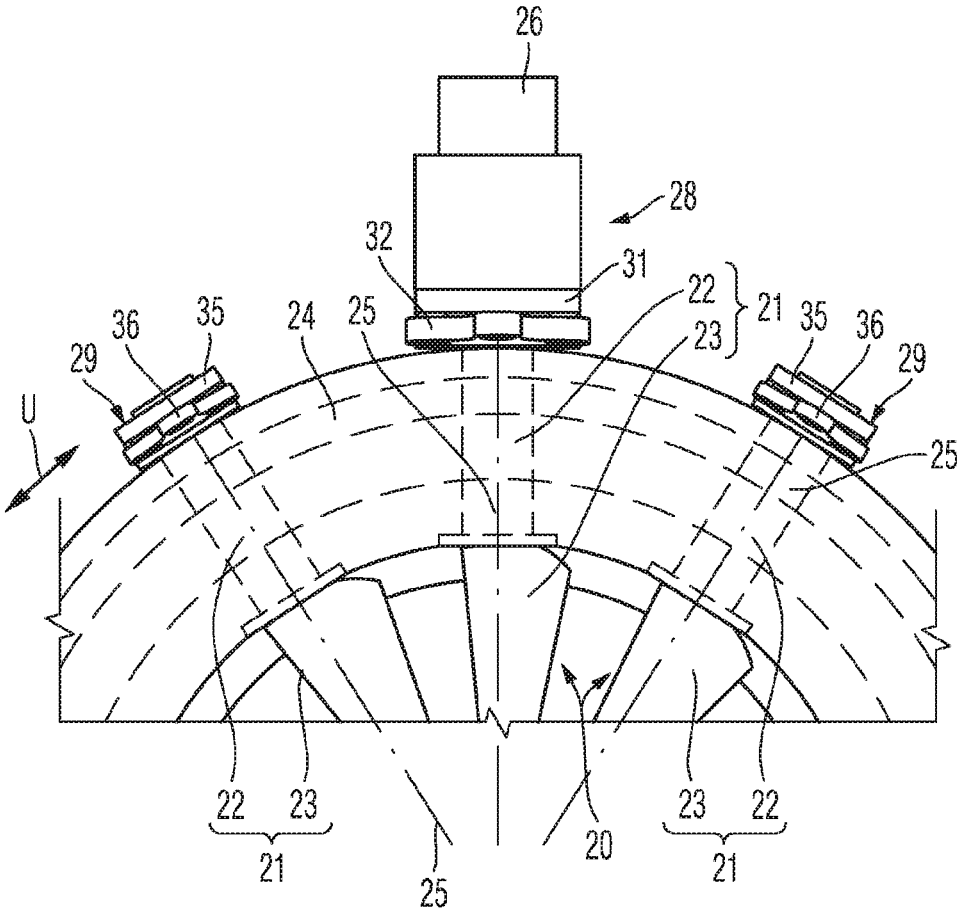
FIG. 3 is a sectional side view from FIG. 2.
Figure 4:
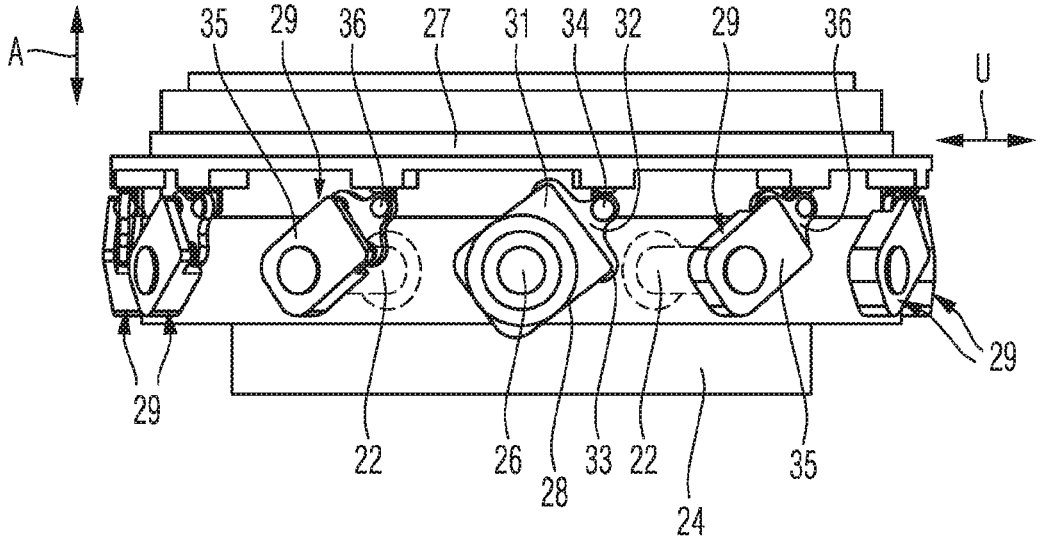
FIG. 4 is a top view of the arrangement from FIG. 1 in a second condition.
Figure 5:
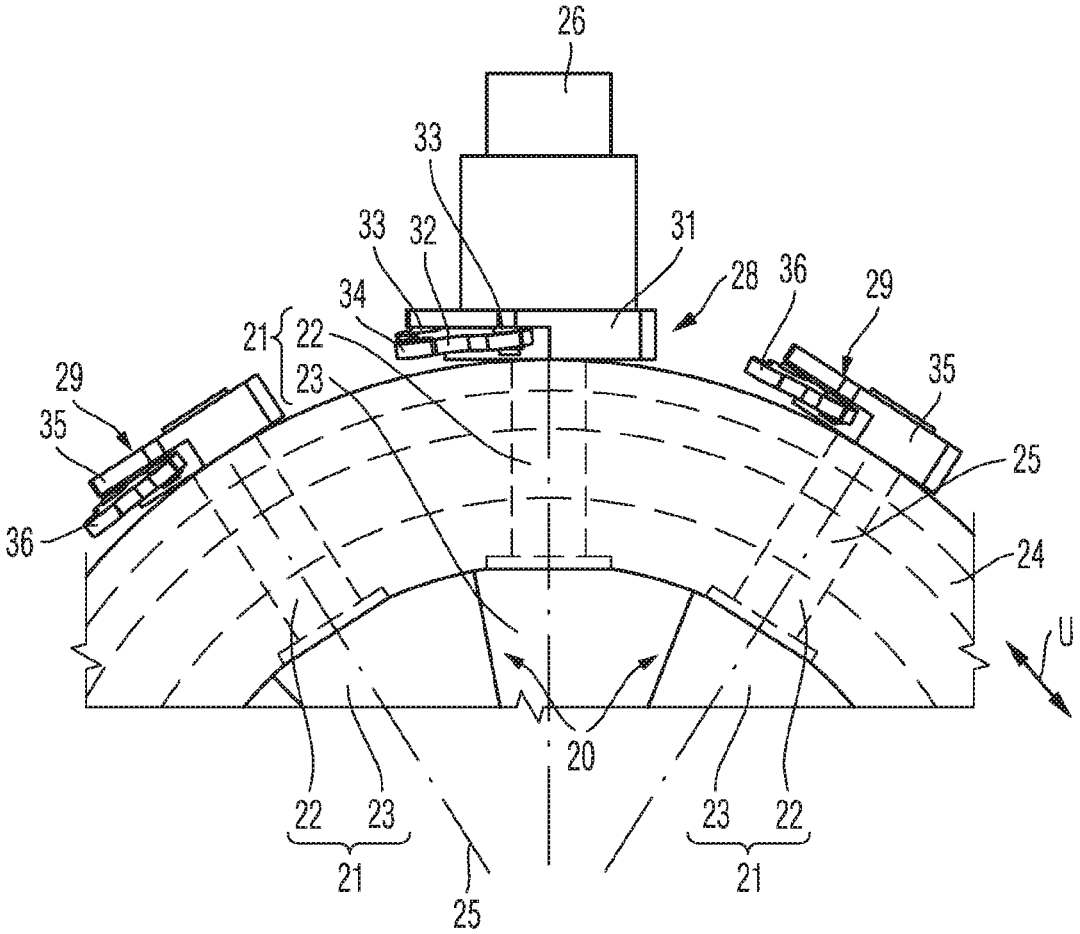
FIG. 5 is a sectional side view from FIG. 4.

A further difference between the embodiment example of FIG. 14 and the embodiment example of FIGS. 2 and 3 consists in the geometric contour of the one-part transmission levers 29, which are resiliently elastically deformable in the transmission portion 43 between the two ends thereof, are therefore constructed so as to be relatively thin-walled in this transition portion 43 compared to the other portions thereof.

All of the embodiment examples have in common that a guide vane 21 of the guide vane ring 20 is drivable directly proceeding from a driveshaft 26. The driveshaft 26 or the directly driven guide vane 21 is coupled with a control ring 27. This coupling is preferably effected via a two-part swiveling lever 28 having preferably three spherical joint bearings. All of the rest of the guide vanes 21 of the guide vane ring 20 are indirectly drivable proceeding from the driveshaft 26 via the control ring 27, these guide vanes 21 being coupled with the control ring 27 via further transmission levers 29. Control ring 27 is radially supported coaxial to the rotational axis of a rotor, not shown, and can carry out an axial linear movement and a rotational movement in circumferential direction so as to be superimposed. The transmission levers 29 that serve to couple the indirectly adjustable guide vanes with the control ring 27 can be constructed of multiple parts or, alternatively, of one part just like the transmission lever 28 serving to connect the directly adjustable guide vane 21 to the control ring 27. While the use of spherical joint bearings in the region of the transmission levers 28, 29 is preferred, hinge joints can also be used.

Figure 7:
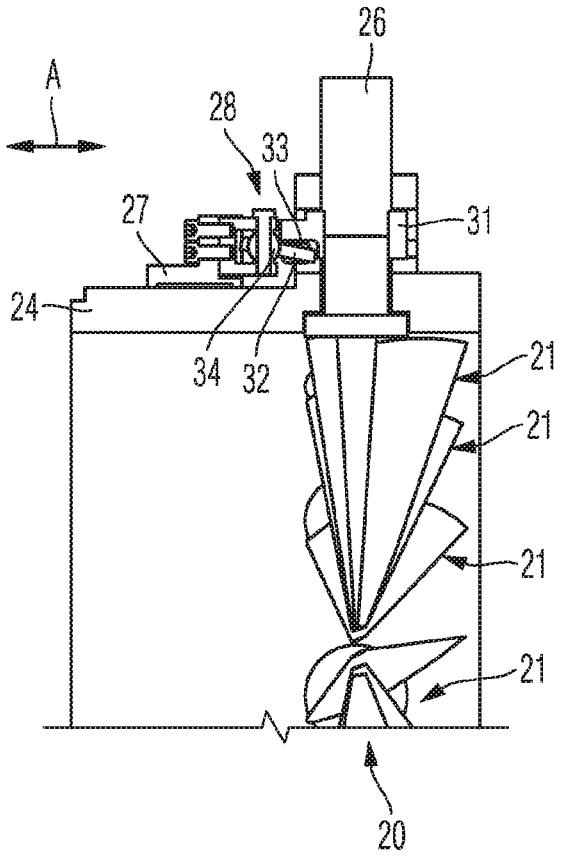
FIG. 7 is a partial cross section through the guide vane adjusting device of FIG. 6 offset by 90° relative to FIG. 1.
Figure 8:
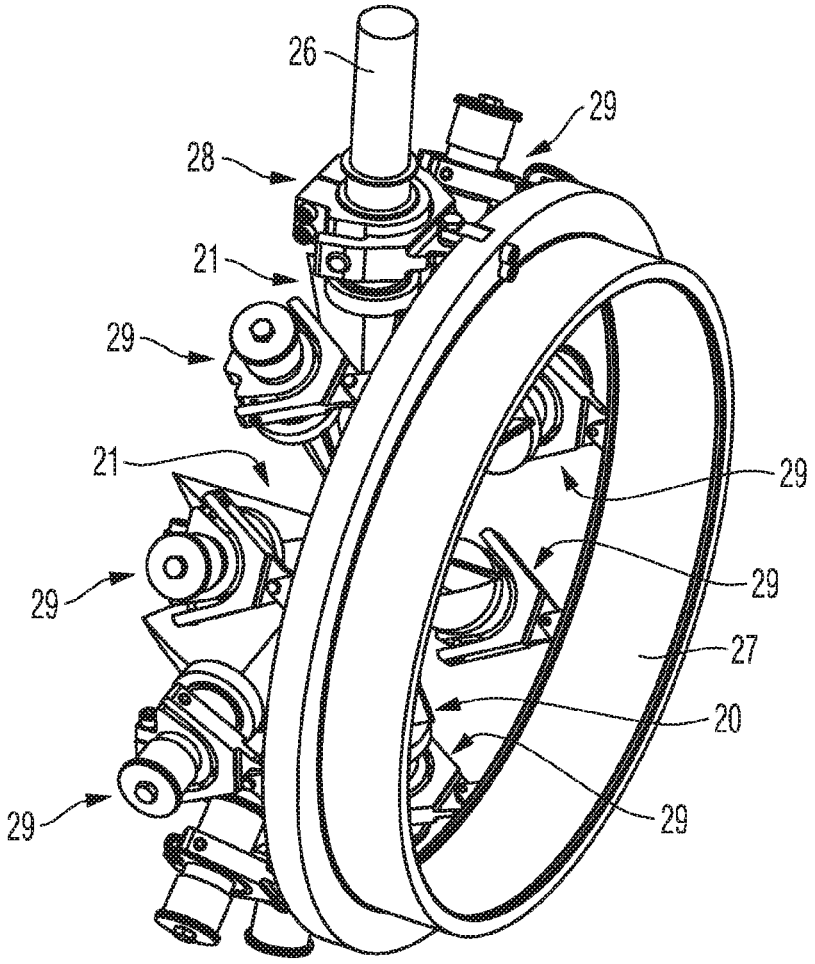
FIG. 8 is a perspective view of the arrangement from FIG. 7 without a housing.
Figure 9:
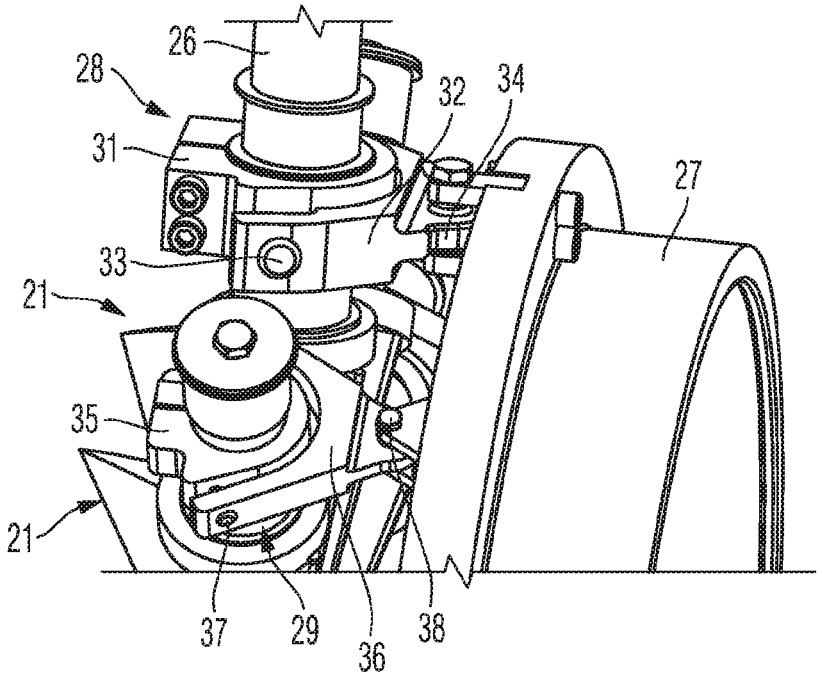
FIG. 9 is a detail from FIG. 8.

In FIGS. 1 to 5, transmission levers 28, 29 engage the radially outer ends of the vane roots outside of the housing structure 24. In FIGS. 6 and 7, the transmission levers 28, 29 engage between the bearings 30 of the transmission levers 28, 29.

With the guide vane adjusting device according to the invention, it is possible to adjust guide vanes of a guide vane ring in an optimal manner, specifically while ensuring a low total friction and a low torsional loading while preventing parasitic forces. The guide vane adjusting device of the present invention provides efficient kinematics for the displacement of the guide vanes of a guide vane ring with low loading of component parts so that high suction pressures can be used in a flow machine that utilizes the guide vane adjusting device.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A guide vane adjusting device for a flow machine, the guide vane adjusting device configured to rotate a plurality of guide vanes, the plurality of guide vanes arranged to form a guide vane ring around a guide vane axis of the guide vane ring, the guide vane adjusting device comprising:

a driveshaft directly coupled to one of the plurality of guide vanes of the guide vane ring at a radially outer portion of the one guide vane such that the one guide vane is directly rotated by the driveshaft, the driveshaft configured to be coupled to and driven by a drive motor;

a control ring arranged radially outside the plurality of guide vanes and configured to transmit a rotation of the driveshaft to rotate all of the plurality of guide vanes of the guide vane ring except the one guide vane directly coupled to the driveshaft, such that the one guide vane directly coupled to the driveshaft is directly rotated by the driveshaft without the control ring as an intermediary;

a multiple-part transmission lever configured to articulatedly couple the control ring to the driveshaft and the one guide vane that is directly rotated by the driveshaft, wherein a first segment of the multiple-part transmission lever is rigidly coupled with one of the drive shaft and the one guide vane that is directly rotated by the driveshaft, and a second segment of the multiple-part transmission lever is articulatedly coupled with the control ring, and such that the first segment of the multiple-part transmission lever is articulatedly coupled with the second segment of the multiple-part transmission lever, wherein a pair of joint bearings are configured to couple the first segment of the multiple-part transmission lever to the second segment of the multiple-part transmission lever, and an individual third joint bearing is configured to couple the second segment of the multiple-part transmission lever to the control ring, wherein the individual third joint bearing is axially offset from the pair of joint bearings with respect to the driveshaft, wherein the driveshaft is indirectly coupled with all of the plurality of guide vanes of the guide vane ring except the one guide vane directly coupled to the driveshaft, such that the plurality of guide vanes indirectly coupled with the driveshaft are indirectly rotated with the control ring as an intermediary;

respective additional single-part transmission levers configured to articulatedly couple the control ring to respective radially outer portions of the plurality of guide vanes that are indirectly rotated by the driveshaft, wherein the control ring is displaceable in a circumferential direction and in an axial direction such that forces exerted at coupling points between the control ring and the respective additional single-part transmission levers run perpendicular to the respective additional single-part transmission levers with respect to the circumferential direction of the control ring, wherein the additional single-part transmission levers are elastically deformable and configured to articulatedly couple the control ring to the driveshaft and the one guide vane that is directly rotated by the driveshaft, wherein a first segment of the respective additional single-part transmission lever is rigidly coupled with one of the driveshaft and the one guide vane that is directly rotated by the driveshaft, and a second segment of the respective additional single-part transmission lever is articulatedly coupled with the control ring, such that the first segment of the respective additional single-part transmission lever is radially in line with the second segment of the respective additional single-part transmission lever for each respective guide vane that is indirectly coupled with the driveshaft.

2. The guide vane adjusting device according to claim 1, wherein each of the additional single-part transmission levers are provided with a respective joint bearing formed between the respective additional single-part transmission lever and the control ring.

3. The guide vane adjusting device according to claim 1, wherein respective additional multiple-part transmission levers are used in lieu of the respective additional single-part transmission levers, the respective additional multiple-part transmission levers configured such that a first segment of the respective additional multiple-part transmission lever is rigidly coupled with a respective guide vane of the plurality of guide vanes, and a second segment of the respective additional multiple-part transmission lever is articulatedly coupled with the control ring.

4. The guide vane adjusting device according to claim 3, wherein the first segment of the respective additional multiple-part transmission lever is articulatedly coupled with the second segment of the respective additional multiple-part transmission lever.

5. A flow machine comprising:

a stator having a plurality of guide vanes, the plurality of guide vanes arranged to form a guide vane ring around a guide vane axis of the guide vane ring; and a guide vane adjusting device configured to adjust the plurality of guide vanes of the guide vane ring, the guide vane adjusting device comprising:

a driveshaft directly coupled to one of the plurality of guide vanes of the guide vane ring at a radially outer portion of the one guide vane such that the one guide vane is directly rotated by the driveshaft, the driveshaft configured to be coupled to and driven by a drive motor;

a control ring arranged radially outside the plurality of guide vanes and configured to transmit a rotation of the driveshaft to rotate all of the plurality of guide vanes of the guide vane ring except the one guide vane directly coupled to the driveshaft, such that the one guide vane directly coupled to the driveshaft is directly rotated by the driveshaft without the control ring as an intermediary;

a multiple-part transmission lever configured to articulatedly couple the control ring to the driveshaft and the one guide vane that is directly rotated by the driveshaft, wherein a first segment of the multiple-part transmission lever is rigidly coupled with one of the drive shaft and the one guide vane that is directly rotated by the driveshaft, and a second segment of the multiple-part transmission lever is articulatedly coupled with the control ring, and such that the first segment of the multiple-part transmission lever is articulatedly coupled with the second segment of the multiple-part transmission lever, wherein a pair of joint bearings are configured to couple the first segment of the multiple-part transmission lever to the second segment of the multiple-part transmission lever, and an individual third joint bearing is configured to couple the second segment of the multiple-part transmission lever to the control ring, wherein the individual third joint bearing is axially offset from the pair of joint bearings with respect to the driveshaft, wherein the driveshaft is indirectly coupled with all of the plurality of guide vanes of the guide vane ring except the one guide vane directly coupled to the driveshaft, such that the plurality of guide vanes indirectly coupled with the driveshaft are indirectly rotated with the control ring as an intermediary;

respective additional single-part transmission levers configured to articulatedly couple the control ring to respective radially outer portions of the plurality of guide vanes that are indirectly rotated by the driveshaft, wherein the control ring is displaceable in a circumferential direction and in an axial direction such that forces exerted at coupling points between the control ring and the respective additional single-part transmission lever run perpendicular to the respective additional single-part transmission lever with respect to the circumferential direction of the control ring, wherein the additional single-part transmission levers are elastically deformable and configured to articulatedly couple the control ring to the driveshaft and the one guide vane that is directly rotated by the driveshaft, wherein a first segment of the respective additional single-part transmission lever is rigidly coupled with one of the driveshaft and the one guide vane that is directly rotated by the driveshaft, and a second segment of the respective additional single-part transmission lever is articulatedly coupled with the control ring, such that the first segment of the respective additional single-part transmission lever is radially in line with the second segment of the respective additional single-part transmission lever for each respective guide vane that is indirectly coupled with the driveshaft.

* * * * *